United States Patent [19]

Connolly

[11] Patent Number: 4,837,104

[45] Date of Patent: Jun. 6, 1989

[54] SCAVENGING FIELD FOR ELECTROSTATOGRAPHIC PRINTING MACHINE

[75] Inventor: Douglas P. Connolly, Webster, N.Y.

[73] Assignee: Xerox Corporation, Stamford, Conn.

[21] Appl. No.: 200,879

[22] Filed: Jun. 2, 1988

[51] Int. Cl.[4] ..... G03G 21/00

[52] U.S. Cl. ..... 430/125; 134/1; 361/225; 355/245; 355/261

[58] Field of Search ..... 430/125; 134/1; 361/225; 355/15

[56] References Cited

U.S. PATENT DOCUMENTS

| | | | |
|---|---|---|---|
| 3,883,349 | 5/1975 | Sato | 361/225 X |
| 4,479,709 | 10/1984 | Syukuri et al. | 355/15 |
| 4,647,186 | 3/1987 | Armstrong et al. | 355/15 |

OTHER PUBLICATIONS

Hausle et al, "Electrophotographic Process", IBM Tech. Discl. Bull., vol. 19, No. 4, Sep. 1976, p. 1412.

*Primary Examiner*—Roland E. Martin

[57] ABSTRACT

An imaging process having reduced toner contamination of the printing machine and copies produced therefrom is provided where successive developed toner images are formed on successive registered areas of an endless imaging member movable through a path past a plurality of processing stations by creating an electrostatic fringe field across the width of the imaging member in advance of the lead edge of developed toner image in a registered area of the image member of sufficient magnitude to attract otherwise contaminating toner thereto as it traverses the path whereby contaminating toner is not attracted to successive registered areas of the imaging member. In a preferred embodiment the fringe scavenger filed has a gradient more than 15 volts per millimeter.

20 Claims, 3 Drawing Sheets

SCAVENGING FIELD FOR ELECTROSTATOGRAPHIC PRINTING MACHINE

BACKGROUND OF THE INVENTION

The present invention relates to a scavenging fringe field for electrostatographic printing machines and more particularly to the use of such as a field to reduce toner contamination and improve copy quality.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

In an ideal printing machine, the toner particles would be confined to only the image areas on the imaging member, the development zone, the cleaning zone and the copy paper. However, as a practical matter, it is very difficult to control the movement of all toner particles and thus some become airborne throughout the xerographic cavity of the machine and come to light or rest on various surfaces of the machine. This is particularly true for toner particles which may escape from either the cleaner sump or the developer housing or both that may be mechanically carried by the imaging member through the various processing stations. This stray toner which may be electrostatically charged to either positive or negative polarity is electrostatically attracted and is deposited on a large number of surfaces. One of the more troublesome areas where significant quantities of stray toner collect is in the cleaner assembly and in particular on the underside of the cleaning blade in an assembly of the construction such as is illustrated in FIGS. 2A and 2B. When the machine is in operation producing prints, the blade tends to observe a tucked position as illustrated in FIG. 2B. However, after a copying run has been completed and the machine is permitted to cycle down and come to rest, the blade tends to become untucked and relaxes so that its underside tends to drop down on the imaging member so that a significant area of the back of the blade may contact the imaging member and any stray toner present thereon will accumulate on the back of the cleaning blade. In a subsequent printing run, this stray toner and in particular the stray toner on the back of the cleaning blade is in very close proximity to the imaging member and may be deposited thereon eventually resulting in a copy quality defect in the final print produced.

The propensity for deposition of stray or contaminating toner on the imaging member is enhanced by the fact that following transfer of toner to the copy sheet and during stripping of the first print during a printing run during transfer and as the lead edge of the copy paper is separated from the imaging member there is an air breakdown between the imaging member and the copy paper resulting in ionization of the air and creation of an electrostatic fringe field on the imaging member. Typically, this fringe field is a narrow field in the width dimension across the imaging member with a large gradient and is of the order of 300 to 500 volts higher than adjacent non-image areas which are of the order, for example, of 250 volts. As this fringe field created at the transfer station continues to pass through the printing machine, it will attract oppositely charged toner for the most part but may also attract some toner of the same charge on each side of the fringe field. Furthermore, if substantial quantities of toner are attracted from the cleaning blade and other surfaces, the stray toner on the imaging member may end up being charged during the next charging step for a second print. In addition, the imaging member may be not discharged by light during exposure since the light does not reach the imaging member having been blocked by the deposited toner particles. The problem is further compounded by the fact that although most development systems do function to scavenge any residual toner present on the imaging member during the development process simultaneously with development of the new latent image in the image areas, this scavenging process is not very efficient when the toner is held by the field formed at transfer and therefore the development process in ineffective in this scavenging role. Furthermore, in those machine configurations wherein there is a precharge discharge device such as a lamp, the imaging member may not be sufficiently discharged in those areas which contain stray toner since the imaging member does not see the light used for the discharge purposes as the stray toner is blocking the light path to the imaging member. Accordingly, the fringe field created during the stripping process may attract sufficient stray toner that survives the scavenging operation during the development process that it will be present on the imaging member in the transfer of the toner image in the second print made in any copying run.

This problem is particularly troublesome in those machine configurations where a registered system is used. That is, a system wherein the images that are formed on the imaging member are formed on the same area or areas of the imaging member for every print or prints that are made. Thus, successive registered areas of the imaging member or plates are used to provide successive developed toner image prints. This is particularly important in those imaging systems wherein a seamed belt is used as the imaging member. The belt is required to be in registration for all prints produced thereon so that the seam does not show up on any of the prints. Typically, this is controlled by the machine sensing the position of a small hole present on one edge of the belt and timing the printing operation for each print from that hole to ensure registration of the image being formed only in the registered area of the belt. In such a machine configuration, the stray toner deposited in the fringe field created on stripping the first copy sheet from the first registered area may result in a copy quality defect in the second print produced in the same registered area of the imaging member if registration for the second print is advanced relative to the registered area on the imaging member for the first print This can occur because of slight variations in the timing windows and imaging member timing hole sensing. While this copy quality defect may be observed on all prints after the first produced in a registered area it is most frequently observed only on the second copy produced in a registered areas because the first fringe field traverses the path past the processing stations and in particular the cleaning blade and it purges most of the toner from these stations, in particular, the back of the blade. During the formation of subsequent prints on a printing run very small residual quantities of toner are observed at the lead edge of the registered areas on the imaging member which in general do not survive the scavenging mechanism of the developing housing.

These difficulties have been previously minimized by discharging the fringe field formed during stripping before that area of the imaging member reaches the cleaner assembly. This may be accomplished either with a preclean corotron as for example, is used in the Xerox 3300 copier or the use of a preclean exposure to discharge the photoreceptor before cleaning. However, both of these techniques are expensive in that they require additional apparatus either in the form of a corotron or an illumination device. In addition to the initial cost of the devices, maintenance and replacements are additional burdens with which the user must contend.

SUMMARY OF THE INVENTION

In accordance with a principle aspect of the present invention, an imaging process where successive developed toner images are formed on successive registered areas on an endless imaging member movable through a path past a plurality of processing stations in an automatic printing machine includes the step of creating an electrostatic fringe field across the width of the imaging member in advance of the lead edge of the developed toner image in a registered area of the imaging member of sufficient magnitude to attract otherwise contaminating toner thereto as the imaging member traverses its path whereby the contaminating toner is not attracted to successive registered areas of the imaging member.

In a further aspect of the present invention, the electrostatic fringe field is created in advance of the electrostatic fringe field created during the stripping of a support member bearing a toner image from the imaging member.

In a further aspect of the present invention, the electrostatic fringe field is created in advance of only the first print in a printing run.

In a further aspect of the present invention, the electrostatic fringe field has a gradient more than 15 volts per millimeter and is created in an interdocument gap between registered areas on the imaging member.

In a further aspect of the present invention, the electrostatic latent fringe field is created by pulsing the transfer corotron.

Other features of the present invention will become apparent as the following description proceeds and upon reference to the drawings.

DESCRIPTION OF THE PREFERRED EMBODIMENT

The invention will now be described with reference to a preferred embodiment of an electrostatographic printing apparatus.

Figure 1:
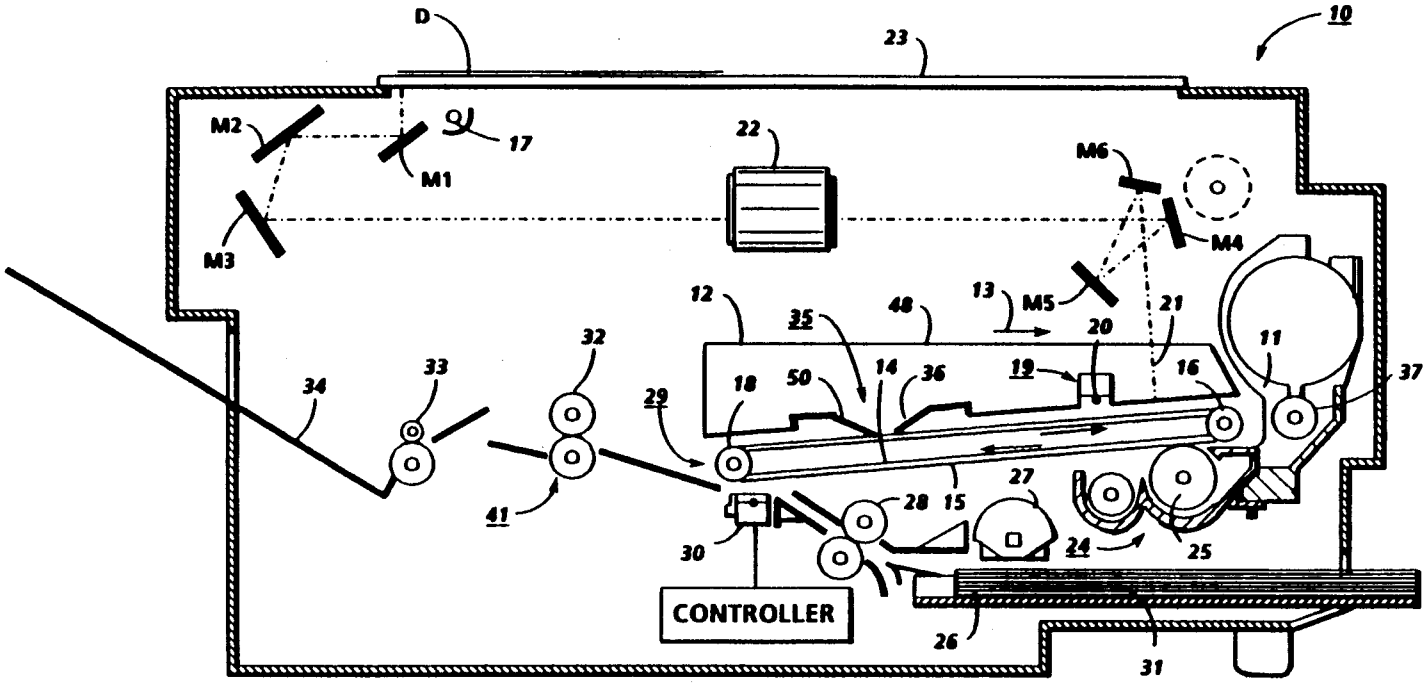
FIG. 1 is a schematic representation in cross section of an automatic electrostatographic reproducing machine with the scavenging fringe field according to the present invention.

Referring now to FIG. 1, there is shown by way of example, an automatic electrostatographic reproducing machine 10 which includes a removable processing cartridge 12. The reproducing machine depicted in FIG. 1 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt-like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of the final support material are supported in a stack arranged on elevator stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image tot he copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scraping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 2A:
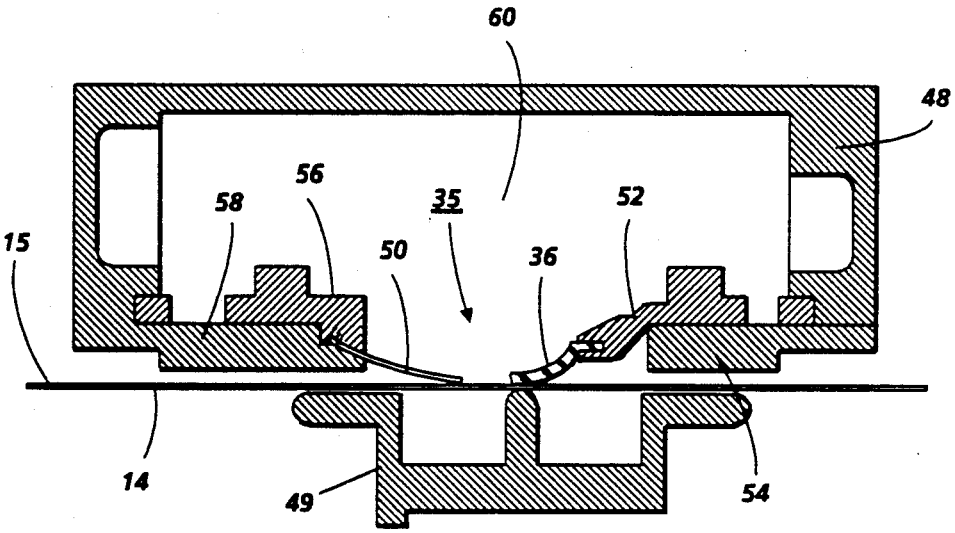
FIGS. 2A and 2B are enlarged schematic representations in cross section of the cleaning assembly illustrating the cleaning blade in the untucked and tucked position respectively.
Figure 2B:
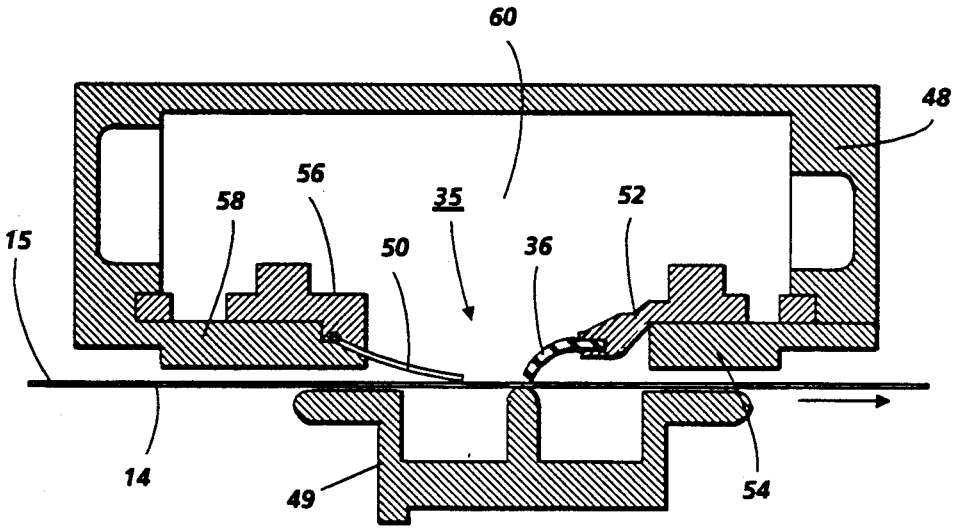

The invention will be further illustrated with reference to FIGS. 2A, 2B and 3A and 3B. In FIGS. 2A and 2B, the photoreceptor belt 14 having a photoconductive insulating surface 15 thereon is transported in the direction of the arrow through the cleaning station 35 which comprises a cleaning platen 49 positioned under the top horizontal run of the imaging belt 14 with a cleaning housing 48 in opposed relationship on the top run of the photoconductive belt 14. Contained within the cleaner housing is a cleaning blade 36 rigidly held in blade holder 52 which is mounted to blade mount 54 which in turn is mounted to the cleaning housing 48. The cleaning blade 36 by virtue of its position and beam deflection is in opposed interference relationship with the top surface of belt 14 supported by cleaning platen 49. Cleaning seal 50 is held by seal holder 56 which is mounted to seal mount 58 upstream in the process direction of the cleaning blade. The seal in contact with the photoreceptor 14 ensures that toner cleaned from the photoreceptor by the cleaning blade 36 does not escape in the upstream direction from the cleaning housing 48. As the photoreceptor 14 travels in the direction of the arrow, any residual toner remaining thereon is cleaned or scrapped from the imaging surface by the blade 36 and transported into the cleaning sump 69. It should be noted that the cleaning blade, cleaning platen, cleaning seal together with the cleaning housing are at least as wide as the imaging area of the photoreceptor belt.

In FIG. 2B, the cleaning blade 36 is in a chiseling orientation with regard to the advancing photoreceptor belt. As the belt moves in the direction indicated by the arrow, the tip of the blade 36 chisels any residual toner from the surface of the belt and pushes it up into the cleaner sump 60. FIG. 2A illustrates the orientation of the blade when the belt is at rest and the blade is in an untucked position in contrast to the tucked position of FIG. 2B. As illustrated when the blade is in the untucked position, it is relaxed and a portion may come into contact with the belt and any loose toner on the belt may transfer to the back of the blade. In view of the orientation of the cleaning blade at roughly the twelve o'clock position, toner material which has been loosened and cleaned from the imaging surface remains in the nip between the cleaning blade and the imaging surface and lubricates the surface of the nip. The cleaning blade may be made of any suitable materials such as metal or plastic but preferably is made from an elastomer such as urethane. The cleaning seal may be made from a suitable material such as polyurethane, cellulose acetate or a polyester such as Mylar.

According to the present invention, an electrostatic fringe field is created across the width of the imaging member in advance of the lead edge of the developed toner image in a registered area of the imaging member which is of sufficient magnitude to attract otherwise contaminating toner to the imaging member as it traverses its path. By creating such an electrostatic fringe field in an area of the imaging member which is outside of or in advance of the leading edge of a registered image area, stray or contaminating toner which otherwise would be be attracted by the electrostatic fringe field formed during stripping of the first image, is collected. In this context, and with further reference to FIG. 1, the imaging member, belt 14 is of sufficient length to be able to contain two registered areas or prints thereon. The same areas of the belt are repeatedly producing prints used since registration of the images is controlled by sensing a hole in the edge of the belt and timing of imaging operations therefrom. Thus, there are two successive registered areas or plates on the endless imaging member. Accordingly, the leading edges of all toner image areas and prints produced therefrom will be registered along the same two lines for all prints.

Figure 3A:
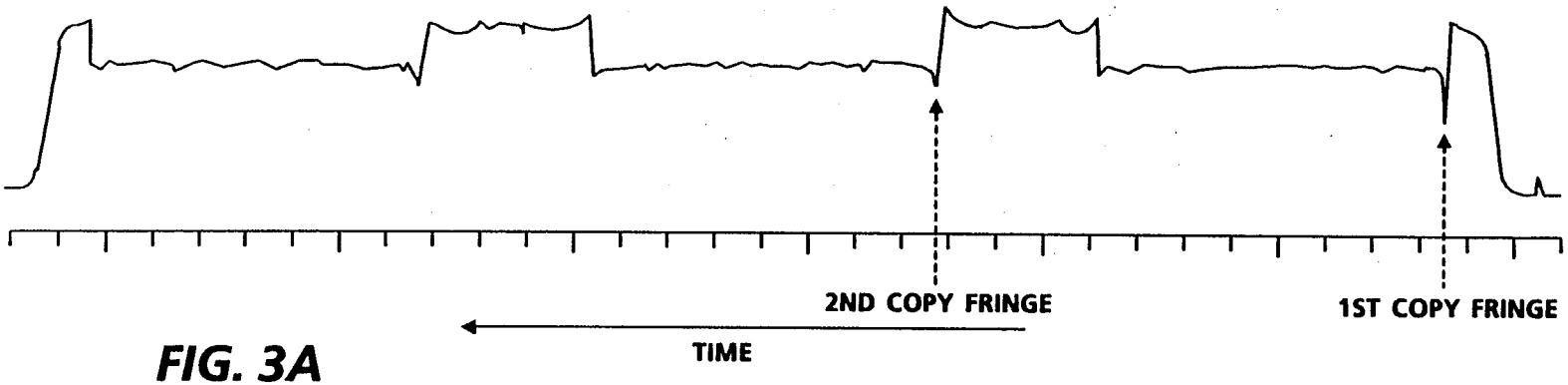
FIG. 3A and 3B are graphical representations respectively of the fringe field created during stripping the first copy sheet in a printing run and after formation of the scavenging fringe field according to the present invention.
Figure 3B:
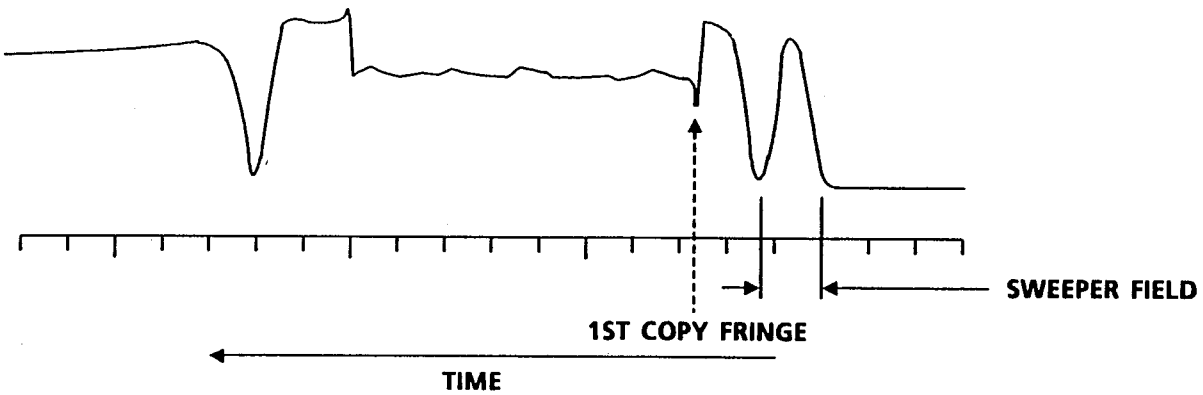

This electrostatic fringe field may be readily created by activating the transfer corotron 30 which normally may operate, for example, at negative 5,000 volts for a short period of time of the order of 150 milliseconds in advance of the lead edge of any registered area or image plate. The activation of the transfer corotron at the appropriate time to create the sweeper fringe field is performed in conventional manner by the controller as illustrated in FIG. 1 in relation to belt hole sensing, belt drive and other imaging operations. It is desired to have as sharp a gradient as possible and in any case at least 15 volts per millimeter since the higher the gradient the more positive the effect in attracting contaminating toner. As a practical matter, however, it is not possible to turn the transfer corotron on and off for less than about 150 milliseconds and thus the fringe field created may be slightly broader than the fringe field created on stripping the first copy sheet from the belt. This may be illustrated by comparing FIGS. 3A and 3B. In FIG. 3A, a representation of an electrometer reading showing the voltage at the fringe field created by the stripping of the first copy from the imaging member and the second copy from the imaging member as a function of the time is illustrated. In FIG. 3B a similar plot is made except that the transfer corotron is energized for a very short period of time just in advance of the lead edge of the image plate and the formation of the first fringe field by stripping the copy sheet from the imaging member. Accordingly, by creating an electrostatic fringe field or sweeper field in an interdocument area on an imaging member unwanted toner on the imaging member may be scavenged or collected so that it will not be deposited in image areas on subsequent prints. While the electrostatic fringe field or sweeper field may be created in advance of every registered area or plate, it has been found that it is not always necessary and that indeed it may be sufficient merely to create this electrostatic fringe field or sweeper field in advance of the first print only rather than for every print that is made. This is believed to be due to the fact that the vast majority of the contaminating or unwanted toner is collected on the xerographic cavity surfaces and the back of the cleaning blade during periods of idleness when the machine has been cycled down and the blade is, for example, in the untucked position. At this time during cycle down toner accumulates on the back of the blade and by creating the first electrostatic fringe field or sweeper field in advance of the fringe field created at stripping it acts to scavenge or collect contaminating or unwanted toner that may be present throughout the path of the imaging member. The amount of contaminating or unwanted toner thereafter collected on surfaces and in particular on the back of the cleaning blade during any printing run is relatively small and does not create a serious problem. By the term printing run t is intended to define a single actuation of the printing machine where any number of prints may be made before continuous operation of the machine is interrupted and it is cycled out. The term sweeper field is used to depict the action of the fringe field in scavenging stray or otherwise contaminating toner.

Thus, according to the present invention, a sweeper fringe field in the non-functional interdocument zone about 150 milliseconds ahead of the first copy created by pulsing the transfer corotron for 150 milliseconds will act to scavenge unwanted toner off the cleaning blade prior to passage of the unavoidable fringe field at the leading edge of the first plate. In the embodiment illustrated in FIG. 1 wherein there are two plates present on the imaging belt in the absence of a sweeper fringe field the third copy lead edge may have a line formed by stray or unwanted toner that was pulled to the imaging member by the electrostatic fringe field created when the first print was stripped from the belt. This contaminating toner reduces discharge of the fringe field and also retains a charge as it is passed through the charge corotron thus inhibiting effective developer scavenging. The line becomes a copy quality defect if the third print registration is advanced relative to the first print registration on the imaging member. The present invention avoids those problems in a cost effective manner in that components already existing in the printing machine are used; it merely being required that the transfer corotron be activated for short period of time in advance of the first copy in a printing run.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to a light image of an original document, the electrostatic latent image may alternatively be generated from information electronically stored or generated in digital form which afterwards be converted to alphanumeric images by image generation and electronics and optics. Accordingly, it is intended to embrace all such alternatives, modifications that may fall within the spirit and scope of the appended claims.

I claim:

1. An imaging process where successive developed toner images are formed on successive registered areas of an endless imaging member movable through a path past a plurality of processing stations in an automatic printing machine comprising the sequential steps of forming an electrostatic latent image on an endless imaging member, developing said latent image with toner, creating an electrostatic fringe field across the width of said imaging member in advance of the lead edge of the developed toner image present in a registered area of the imaging member of sufficient magnitude to attract otherwise contaminating toner thereto as it traverses said path whereby said contaminating toner is not attracted to successive registered areas of the imaging member, transferring said toner image to an image support substrate, and cleaning said imaging member to remove residual toner in preparation for the formation of the next electrostatic latent image.

2. The process of claim 1 wherein said fringe field is created in advance of only the first print in a printing run.

3. The process of claim 1 wherein said fringe field is created in advance of every print in a printing run.

4. The process of claim 1 wherein said fringe field has a gradient more than 15 volts per millimeter.

5. The process of claim1 wherein the endless imaging member has more than one registered area and said fringe field is created in an interdocument gap between said registered areas on the imaging member.

6. The process of claim 1 wherein said endless imaging member is a seamed endless belt having at least two registered areas.

7. The process of claim 1 wherein the step of transferring the toner image to an image support member includes the steps of bringing said support member into contact with said developed toner image on said imaging member, electrostatically attracting said toner image to said support member and stripping said support member from said imaging member whereby a second electrostatic fringe field is created along the leading edge of a registered area of the imaging member.

8. The process of claim 7 wherein said toner is electrostatically attracted to said support member by an energized corona generating device.

9. The process of claim 8 wherein said electrostatic fringe field is created by pulsing said corona generating device before said toner is transferred.

10. The process of claim 1 wherein the step of cleaning said imaging member includes contacting said movable imaging member with a stationary cleaning blade to clean residual toner therefrom, said blade having contaminating toner thereon which is attracted to said fringe field.

11. A method of reducing toner contamination in an imaging process where successive developed toner images are formed on successive registered areas of an endless imaging member movable through a path past a plurality of processing stations in an automatic printing machine comprising the sequential steps of forming an electrostatic latent image on an endless imaging member, developing said latent image with toner, creating an electrostatic fringe field across the width of said imaging member in advance of the lead edge of the developed toner image present in a registered area of the imaging member of sufficient magnitude to attract otherwise contaminating toner thereto as it traverses said path whereby said contaminating toner is not attracted to successive registered areas of the imaging member, transferring said toner image to an image support substrate, and cleaning said imaging member to remove residual toner in preparation for the formation of the next electrostatic latent image.

12. The process of claim 11 wherein said fringe field is created in advance of only the first print in a printing run.

13. The process of claim11 wherein said fringe field is created in advance of every print in a printing run.

14. The process of claim 11 wherein said fringe field has a gradient more than 15 volts per millimeter.

15. The process of claim 11 wherein the endless imaging member has more than one registered area and said fringe field is created in an interdocument gap between said registered areas on the imaging member.

16. the process of claim 11 wherein said endless imaging member is a seamed endless belt having at least two registered areas.

17. The process of claim 11 wherein the step of transferring the toner image to an image support member includes the steps of bringing said support member into contact with said developed toner image on said imaging member, electrostatically attracting said toner image to said support member and stripping said support member fromsaid imaging member whereby a second electrostatic fringe field is created along the leading edge of a registered area of the imaging member.

18. The process of claim 17 wherein said toner is electrostatically attracted to said support member by an energized corona generating device.

19. The process of claim 18 wherein said electrostatic fringe field is created by pulsing said corona generating device before said toner is transferred.

20. The process of claim 11 wherein the step of cleaning said imaging member includes contacting said movable imaging member with a stationary cleaning blade to clean residual toner therefrom, said blade having contaminating toner thereon which is attracted to said fringe field.

* * * * *